United States Patent [19]

Lemmer

[11] Patent Number: 4,528,535

[45] Date of Patent: Jul. 9, 1985

[54] ELECTROMAGNETIC SWITCHING DEVICE

[75] Inventor: Helmut Lemmer, Marienheide-Kalsbach, Fed. Rep. of Germany

[73] Assignee: Starkstrom Gummersbach GmbH, Marienheide, Fed. Rep. of Germany

[21] Appl. No.: 504,843

[22] Filed: Jun. 17, 1983

[30] Foreign Application Priority Data

Jun. 19, 1982 [EP] European Pat. Off. ..... 82105390.7

[51] Int. Cl.[3] ..... H01H 69/01

[52] U.S. Cl. ..... 335/273; 335/270; 335/132

[58] Field of Search ..... 335/42, 45, 86, 132, 335/258, 261, 262, 270, 271, 272, 273, 279

[56] References Cited

U.S. PATENT DOCUMENTS 3,878,491 4/1975 Rauter et al. ..... 335/270

*Primary Examiner*—E. A. Goldberg
*Assistant Examiner*—George Andrews
*Attorney, Agent, or Firm*—Michael J. Striker

[57] ABSTRACT

Disclosed is an electromagnetic switching device of the type having a stationary core and a movable armature pivotably mounted in a guiding support. To adjust and re-adjust the stroke of the armature, the latter is provided with a removable pivot shaft having a polygonal central portion matching the corresponding passage in the armature. The cylindrical ends of the carrier shaft are coaxial with its axis of rotation, whereas the sides of the polygonal portion are unevenly spaced from the axis. An end face of the shaft is provided with indexing marks denoting the selected angular position of the shaft relative to the armature.

5 Claims, 6 Drawing Figures

ELECTROMAGNETIC SWITCHING DEVICE

BACKGROUND OF THE INVENTION

The present invention relates generally to electromagnetic switching devices, particularly to circuit breakers of the type having a stationary magnetic core and a movable armature which is supported for movement above the core in a guiding member.

In electrical switching devices of this kind it is very important that the stroke of the armature, that is the spatial interval which the armature travels from its starting position on actuation of the switching device up to its abutment on the magnetic core, be adjusted accurately. In practice, this requirement cannot be accurately fulfilled, and the resulting inaccuracy has been tolerated. There are different reasons for this inaccuracy. For example, in manufacturing of the switching devices, certain production tolerances which affect the actual stroke of the armature, are unavoidable. In addition, in operation of the switching device certain changes in the stroke of the armature occur after a certain time period, either due to wear or burning of the contact pieces present in the switching system. As a result, an interfering buzzing of the magnetic drive will occur.

SUMMARY OF THE INVENTION

A general object of the present invention is to avoid the aforementioned disadvantages.

In particular, it is an object of the invention to provide a switching device of the aforedescribed kind which makes it possible to adjust or additionally readjust the correct stroke of the magnetic drive.

Another object of this invention is to provide such a stroke adjustment by simple construction means.

In keeping with these objects and others which will become apparent hereafter, one feature of the invention resides, in the electric switching devices of the aforedescribed kind, in the provision of a carrier shaft defining an intermediate peripheral portion of a polygonal cross section, the armature having a passage for engaging the polygonal portion of the shaft, the shaft being pivotally supported on the guiding structure to rotate the armature about a pivot axis, and the individual sides of the polygonal portion of the carrier shaft being unevenly spaced from the pivot axis. The ends of the carrier shaft are provided with cylindrical bearings which are coaxial with the pivot axis. In this manner, the stroke of the armature can be adjusted in a very simple manner by withdrawing the carrier shaft from the passage of the armature, changing the angular position of the shaft so that upon its reinsertion in the armature a different side of its polygonal section engages the bearing side of the passage in the armature. In this manner the disturbing buzzing of the magnetic drive can be eliminated.

In a preferred embodiment, the intermediate portion of the shaft has a square cross section and an end face of the carrier shaft is provided with index marks for indicating the selected position of the square portion. The size of the polygonal or square portion can have a slightly convex or inclined shape.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
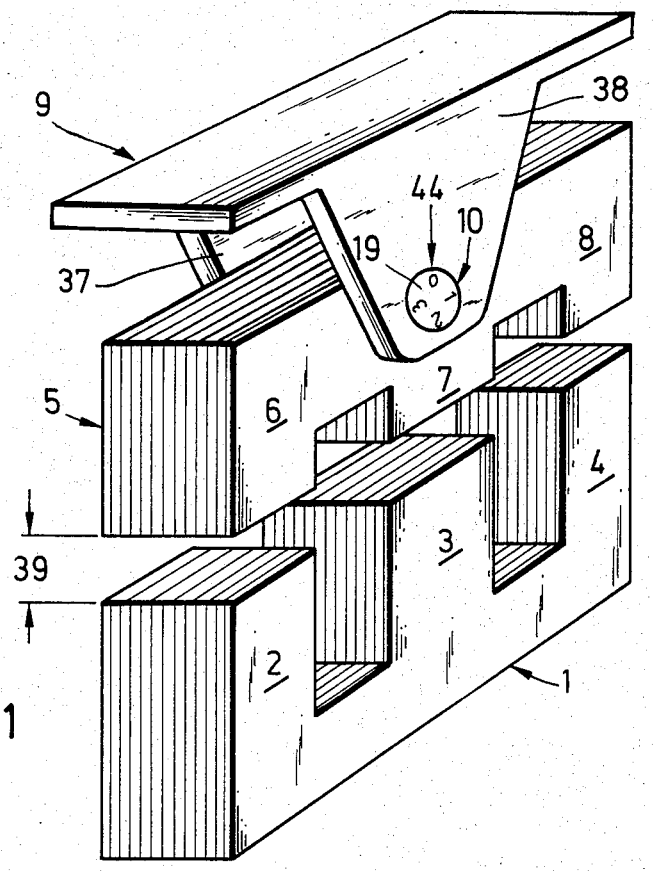
FIG. 1 is a perspective view of an embodiment of the electric switching device of this invention, shown in its rest position.

FIG. 1 shows in a simplified perspective view a component part of an electric switching device, namely a part of a magnetic driving system having a stationary magnetic core 1 and an armature 5. In this embodiment, core 1 has three upright legs 2, 3 and 4 and the armature has corresponding legs 6, 7 and 8. The armature is pivotally supported on a guiding structure 9 at a distance 39 above the core and this distance determines the stroke of the armature. The guiding structure which, for the sake of clarity is depicted in greatly simplified manner, can in practice have a different configuration matching the particular application of the switching device. It is only important that the armature 5 be movably mounted relative to the core to perform the stroke 39.

Figure 2:
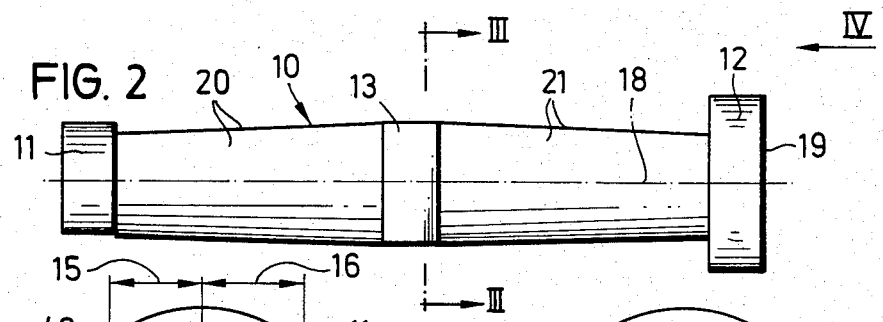
FIG. 2 is a side view of a carrier shaft in the device of FIG. 1, shown on an enlarged scale.
Figure 3:
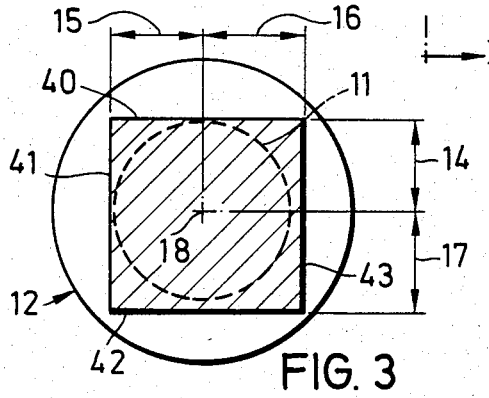
FIG. 3 is a sectional side view of the carrier pin taken along the line III—III in FIG. 2 and shown on an enlarged scale.

In order to adjust or refit the stroke of the armature to the magnetic drive, the armature 5 is pivotably mounted on the guiding structure 9 by means of a carrier pin or shaft 10. Both ends 11 and 12 of the carrier shaft have a cylindrical configuration and are coaxial with the pivot axis of the shaft. The ends 11 and 12 are supported in corresponding bearings in the opposite arms 37 and 38 of the guiding structure 9. It will be seen from FIGS. 2 and 3 that a portion of shaft 10 between the bearing ends 11 and 12 has a polygonal cross section defining a plurality of peripheral faces which are spaced unevenly from the center axis 18 of the carrier shaft 10. It will be seen from FIG. 6 that the armature 5 has a throughgoing passage of a cross section corresponding to the polygonal portion 13 of the carrier shaft 10. The diameter of the cylindrical bearing end 11 is smaller than the clearance of the throughgoing passage in the armature, so that the pin can be inserted from this end through the bearing in the arm 39 of the guiding support into the passage of the armature. In the preferred embodiment, the polygonal portion 13 of the shaft 10 has a square cross section. If desired, however, it may have also a triangular, pentagonal, octagonal, or the like, cross sections. It is essential however that the peripheral sides 40, 41, 42 and 43 of the polygonal section 13 be unevenly spaced from the center axis 18 of the shaft, that is the spacing 15 is not equal to the spacing 16, and the spacing 14 is not equal to the spacing 17. For example, in the preferred embodiment of this invention, the spacing 14 amounts to approximately 3 mm, spacing 15 is 3.2 mm, spacing 16 is 3.4 mm, and the spacing 17 is 3.6 mm.

Depending on the angular position of the carrier pin in the armature, the stroke 39 of the latter can be adjusted in four steps of 0.2 mm each, that is, in the case of a square polygonal portion it can be adjusted about 0.6 mm.

It is also of advantage when, while the bearing cylinder 11 has a smaller diameter than the cross section of the polygonal portion 13, the opposite cylindrical bearing end 12 has a larger diameter than the cross section of the portion 13, so as to serve as a limit stop for the shaft in its guiding support and also serves as an indicator of the angular position of the shaft.

Figure 4:
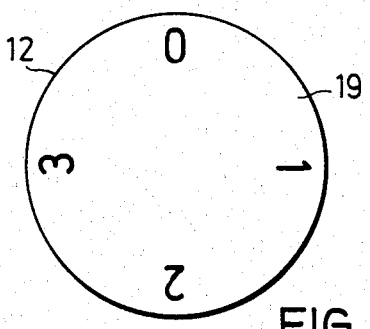
FIG. 4 is a front view in the direction of arrow IV in FIG. 2 of the carrier shaft.

For this purpose, according to a further elaboration of this invention, the end face 19 of the cylindrical bearing 12 is provided with index marks denoting the selected angular position of the carrier shaft relative to the armature 5, as depicted in FIG. 4. The index marks can be in digital form alignable with arrow 44 on the arm 38 of the guiding support 9 (FIG. 1).

In a further modification of this invention, the surfaces 40–43 of the polygonal portion 13 can be slightly curved outwardly. Furthermore, it is also advantageous that surfaces 20 and 21 between the polygonal portion 13 and the ends 11 and 12 of the shaft slightly converge toward the assigned bearing ends. In this manner it is possible to adjust the position of the armature 5 not only to compensate for changes in the stroke 39 but also the armature can be adjusted in transverse direction.

Figure 5:
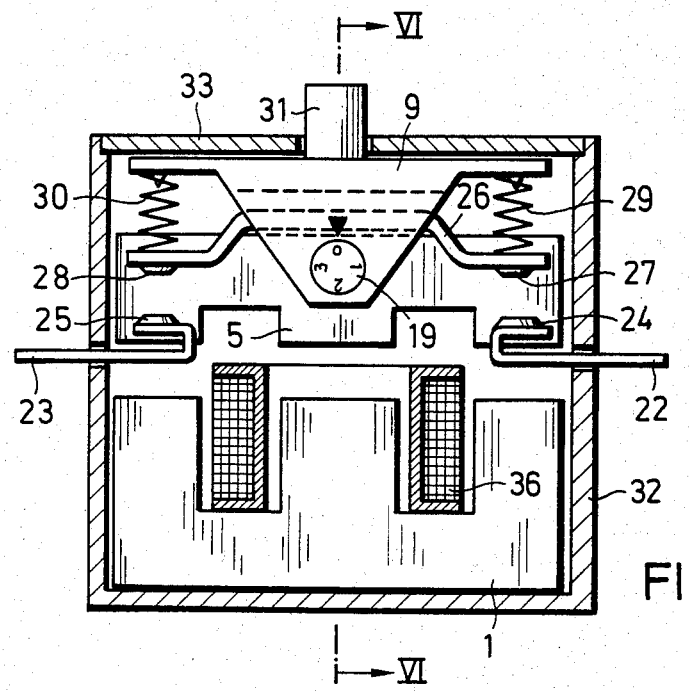
FIG. 5 is a sectional side view of a simplified version of the electric switching device of this invention.
Figure 6:
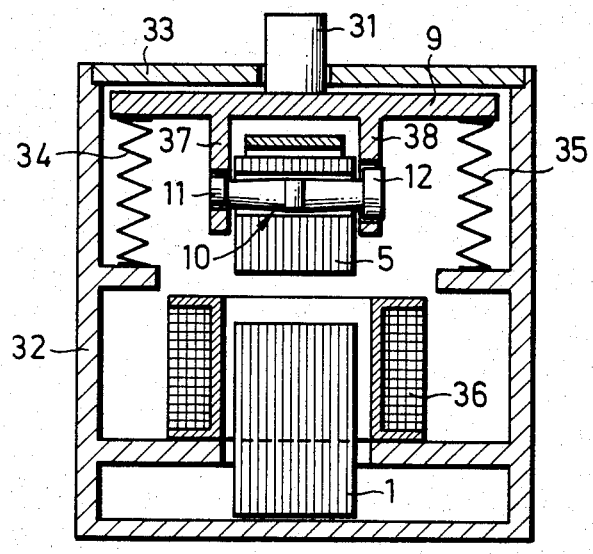
FIG. 6 is a sectional view of the device of FIG. 5, taken along the line VI—VI.

FIGS. 5 and 6 show an example of a simplified electromagnetic switching device including a housing 32 covered by an upper part or lid 33. Opposite lateral walls of the housing 32 support fixed contact terminals 22 and 23 provided with fixed contact pieces 24 and 25. The latter contact pieces cooperate with opposite movable contact pieces 27 and 28 mounted on a contact bridge 26 which rests on the upper surface of the armature 5. Pressure springs 29 and 30 arranged between the guiding support 9 and the opposite ends of the contact bridge 26 hold the same and thus the armature 5 in the illustrated neutral position. The guiding support 9, as depicted in FIG. 6, is mounted on return springs 34 and 35 seated on projecting shoulders in the inner wall of housing 32 and urging the guiding support 9 and hence the armature 5 away from the stationary core 1. A control knob 31 in the lid 33 can depress the guiding support 9 with armature 5 against the force of return spring 34 and 35. The core 1 is provided with coil 36 surrounding the central leg 3.

The aforedescribed adjustment or re-adjustment of the position of the stroke of the armature 5 is accomplished in such a manner that, after removal of the housing lid 33, the guiding support 9 with the armature 5 are lifted from the housing 32, the carrier shaft 10 is withdrawn from the armature and turned about its axis 18 into the desired position in which it is reinserted into the passage of the armature. Thereafter the switching device is readily reassembled in the reverse order.

It will be understood that each of the elements described above, or two or more together, may also find a useful application in other types of constructions differing from the types described above.

While the invention has been illustrated and described as embodied in a specific example of an electric switching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electric switching device, particularly an electromagnetic switch having a stationary magnetic core, a movable armature and a guiding support for the armature, comprising a carrier shaft insertable in the armature and defining a pivot axis, said shaft having cylindrical ends coaxial with the axis and a portion between the ends which has a polygonal cross section; said armature being provided with a passage for receiving said carrier shaft, at least a portion of said passage fitting the polygonal portion of said shaft; said cylindrical ends of the shaft being insertable in the guiding support and the sides of the polygonal shaft portion being unevenly spaced from said pivot axis; and means for changing angular position of the polygonal shaft portion relative to the fitting portion of said armature passage to adjust different clearances between the stationary magnetic core and the armature.

2. An electric switching device as defined in claim 1, wherein said polygonal portion of the shaft has a square cross section.

3. An electrical switching device as defined in claim 1, wherein one of the cylindrical ends of the carrier shaft is larger in diameter than said passage in the armature and its end face is provided with index marks corresponding to the positions of the carrier shaft relative to the armature.

4. An electric switching device as defined in claim 1, wherein the sides of the polygonal portion of the shaft have a slightly convex configuration.

5. An electric switching device as defined in claim 1, wherein the parts of the carrier shaft between the polygonal portion and the respective cylindrical ends slightly converge towards the assigned ends.

* * * * *